United States Patent [19]

Tounjian

[11] Patent Number: 4,468,823

[45] Date of Patent: Sep. 4, 1984

[54] GROUND COVERING ASSEMBLY

[76] Inventor: "Alfie" Alfred Tounjian, 19825 N. Miami Ave., Miami, Fla. 33160

[21] Appl. No.: 423,994

[22] Filed: Sep. 27, 1982

[51] Int. Cl.[3] ..... A47G 9/06

[52] U.S. Cl. ..... 5/417; 5/462

[58] Field of Search ..... 5/413, 417–420, 5/462, 485

[56] References Cited

U.S. PATENT DOCUMENTS

| | | | |
|---|---|---|---|
| 3,176,315 | 4/1965 | Freund | 5/417 |
| 3,226,737 | 1/1966 | Rote | 5/417 |
| 4,231,125 | 11/1980 | Tittl | 5/485 |

*Primary Examiner*—Alexander Grosz

*Assistant Examiner*—M. Trettel

*Attorney, Agent, or Firm*—John Cyril Malloy

[57] ABSTRACT

A spread or ground covering sheet or towel structure of the type used to cover a portion of the ground surface so that one or more people can lie thereupon when sunbathing or enjoying like recreational activities. The ground cover is defined by a flexible sheet made from cloth or like flexible material which includes a pouch structure secured to depend from the undersurface and accordingly positioned to be buried within the ground covered by the sheet. The pouch is sufficiently structured and dimensioned to hold valuables such as keys, money, etc. in an out of sight location so as to prevent theft when the sheet is not occupied.

7 Claims, 4 Drawing Figures

GROUND COVERING ASSEMBLY

BACKGROUND OF THE INVENTION

1. Field of the Invention

This invention relates to a spread or ground cover in the form of a sheet of the type used when sunbathing or visiting beach areas and further includes structure of a pouch like container for secretly holding or storing valuables in a location not readily apparent when viewing the exposed surface area of the sheet.

2. Description of the Prior Art

It is common practice to use some type of cloth or like material sheet to cover ground surface areas when sunbathing at the beach or other appropriate location. Commonly, beach towels or any sheet like structure such as bedspreads, regular blankets, etc. are utilized to prevent a sun bather's body from coming into direct contact with the ground surface. While such structures are of course effective for generally preventing the user's body from becoming soiled, therein is a generally well recognized problem normally encountered when one sunbathes in a public area. This problem is associated with the placement or storage of valuables when one wants to leave the spread or ground cover such as when the user goes swimming and/or otherwise temporarily vacates the immediate area surrounding the ground cover.

It is of course inconvenient to carry a conventional purse or wallet when one leaves the area to go swimming. The placement of valuables in the pocket of a swimming suit is also considered generally impractical, since the objects will obviously get wet when swimming occurs.

A generally accepted alternative is to hide or otherwise place the accompanying valuables in an out of sight location. Frequently people place such valuables in shoes, under towels, etc. thereby leaving such valuables open for theft or otherwise unauthorized use.

Accordingly, there is an obvious need in the art for a ground covering structure, beach blanket or like sheet which incorporates some type of storage device. Such storage area or pocket should be structured so as to locate the intended valuables or other articles out of sight of the exposed surface of the sheet when the user thereof leaves the area. Also, such a container should be capable of being closed and the entrance thereof itself should be difficult to normally find when one casually leaves the sheet whether or not it is being used or occupied by a sunbather. Finally, the overall preferred structure should be designed so as to not appreciably add to the cost of a beach towel or ground spread above that normally associted with such articles by the general consuming public.

SUMMARY OF THE INVENTION

The present invention is directed towards a ground covering structure generally comprising a sheet element. The sheet element is formed from cloth or any other like flexible, natural or synthetic material having sufficient comfort to accommodate the body of a sunbather. In addition, the sheet element should be sufficiently dimensioned to accommodate one or a plurality of sunbathers on the exposed surface thereof. The purpose of the intended ground covering structure is of course to provide undue soiling of the body of a sunbather when one lies upon the ground or other surface to enjoy the recreational benefits of the shoreline or while sunbathing as aforementioned. The sheet element may be multi-sided and have a plurality of general configurations so long as it accommodates the intended number of users. In addition, the flexibility of the material utilized in structuring the sheet element should be sufficient to generally conform to the configuration of the ground surface over which it is spread. An important structural feature of the present invention is the provision of a pouch structure which defines a container for the storage of valuables therein. The pouch structure includes a side wall means disposed to depend from the undersurface of the sheet element in a manner which allows it to be buried in the ground immediately beneath the surface area being covered by the sheet element. The side wall means of the pouch structure is preferably formed from a water impermeable material or alternately may include some type of liner structure which is also waterproof. Obviously, this is provided to prevent the contents of the pouch structure from exposure to any undue moisture.

The pouch structure includes an entrance means which is secured to side portions of the sheet element in a manner so as to be positioned contiguous the exposed surface of the sheet element. This attachment is such that the peripheral portion of the entrance means effectively overlaps or is otherwise oriented so as to appear to be part of the exposed surface. This of course is accomplished in order to prevent detection of the entrance thereby maintaining the existence of such a buried pouch structure secret. Closure means are attached about the peripheral portions of the entrance means and are specifically structured to matingly engage the outermost peripheral edge portions of the side walls of the pouch structure so as to completely close the entrance means when desired.

In actual use such a closure means could be defined by oppositely disposed strips which respectively define hook and loop type fasteners commonly known on the market as Velcro fasteners. However, the intended closure means is not limited to this type of hook and loop type fastener but could take any of a number of structural embodiments capable of providing adequate closure so as to accomplish substantial encasement of the objects stored within the pocket structure.

BRIEF DESCRIPTION OF THE DRAWINGS

For a fuller understanding of the subject invention, reference should be had to the following detailed description taken in connection with the accompanying drawings, in which.

Similar reference characters refer to similar parts throughout the several views of the drawings.

DETAILED DESCRIPTION OF THE PREFERRED EMBODIMENT

Figure 1:
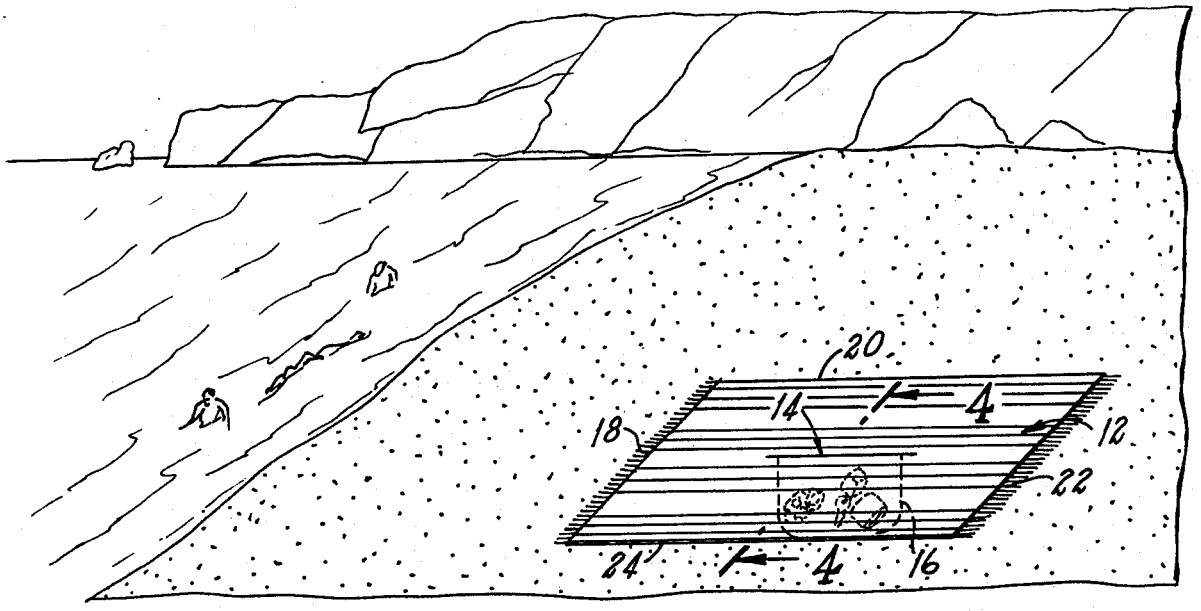
FIG. 1 is an isometric view of the ground covering assembly of the present invention being placed in a beachlike environment for which it is normally intended.

As clearly shown in FIG. 1, the present invention is directed towards a ground covering or spread type structure of the type used for sunbathing at beach areas as shown in FIG. 1. More specifically, the ground covering assembly comprises a sheet element generally indicated as 12 having longitudinally extending side portions 20 and 24 and oppositely disposed ends 18 and 22. The sheet element 12 is preferably formed from a cloth or like flexible material which is generally comfortable to the user or sunbather when lying thereupon. Also, the material should be sufficiently flexible to at least generally conform to the surface configuration of the ground 17 which is being covered.

An important structural feature of the present invention is the existence of a pouch structure generally indicated as 14. The pouch structure includes side wall means 16 attached to the sheet element 12 so as to depend from the underside thereof as clearly shown in FIG. 4.

Figure 2:
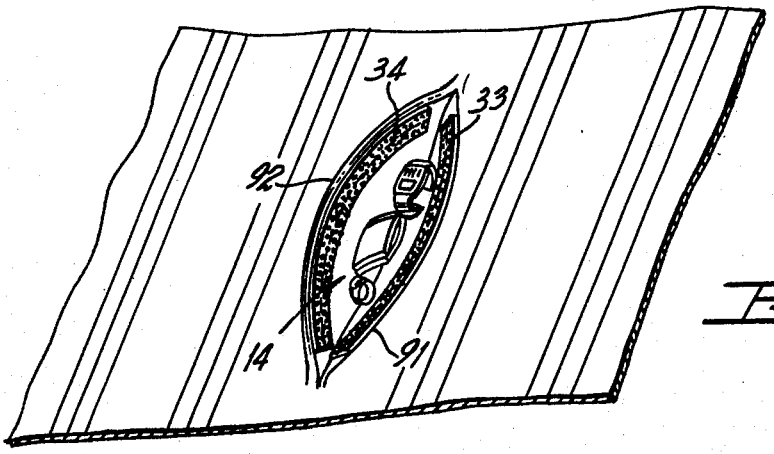
FIG. 2 is an isometric view in partial cutaway showing structural details of the entrance and closure portions of the pouch structure of the present invention.

The pouch structure comprises an entrance means which is disposed to be substantially contiguous to the exposed surface (FIG. 2) of the sheet element 12. As will be explained in greater detail hereinafter, the overall pouch structure 14 is secured and/or attached to the sheet element 12 in such a manner as to prevent the entrance means, indicated in FIG. 2 by peripheral edges 91 and 92, from being readily discerned when viewing the exposed surface of the sheet element 12.

Figure 4:
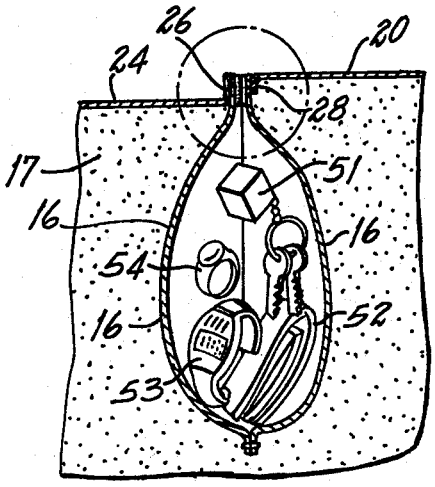
FIG. 4 is a sectional view taken along line 4—4 of FIG. 1 showing the structural features of the interior of the subject pouch structure.

Accordingly, an important operational feature of the pouch structure 16 is to serve as a container in which to store various objects or valuables when sunbathing or enjoying the beach or shoreline recreational activities. As best shown in FIG. 4, the depending disposition of the side wall means 16 allows for the pocket structure to be buried within the ground 17 immediately below the surface area being covered by the sheet element 12. Therefore, the various valuables or objects are maintained and stored in a "secret" out of sight location which is not readily detectable when viewing the exposed surface of the sheet element 12. As is common, such valuables or articles could include a key chain 51, wallet or billfold 52, watch 53, ring 54, etc.

Figure 3:
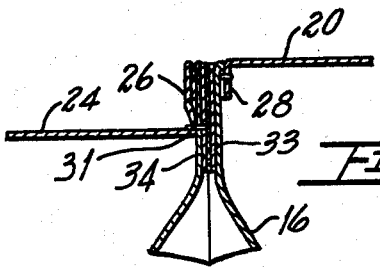
FIG. 3 is a sectional view in partial cutaway showing structural details of the closure means of the present invention.

As best shown in FIG. 3, the entrance means is attached to the side portions 20 and 24 of the sheet element 12 in a manner such that the entrance means is substantially contiguous to the exposed surface of the sheet element 12. This is readily accomplished by attaching side portion 20 to the extreme outer most peripheral edge of the side wall means 16 of the pouch structure as at 28. Portion 24 of the sheet element is accordingly also attached to the outermost peripheral edge on the opposite side wall means 16 thereof but in a greater spaced apart distance than at 28. More specifically, portion 24 of the sheet element 12 is attached at 31 at a generally lower or spaced apart position than as at 28. The peripheral edge 26 of the portion 24 being somewhat greater in length allows an overlapping or generally contiguous orientation of the entrance means relative to the exposed surface or the plane defined by the side portions 20 and 24 of the sheet element 12.

The pouch structure further includes a closure means attached substantially in the vicinity of the entrance means and extending along the length of the entrance means so as to completely close the pouch structure, thereby encasing the objects 51 through 54 therein. In the preferred embodiment, the closure means includes a pair of oppositely disposed elongated strips 33 and 34 attached immediately in the vicinity of the edges 91 and 92 of the entrance means (see FIG. 2) wherein the elongated strips 33 and 34 are specifically structured for mating, close engagement with one another thereby completely sealing the entrance to the interior of the pocket structure 14. Again, in a preferred embodiment of the present invention, the strips 33 and 34 can be conventional hook and loop type fasteners commonly known as Velcro fasteners which are commercially available. However, it should be emphasized that other type of closure means can adequately be applied to the pouch structure so as to maintain it in a closed orientation, thereby preventing access to the interior of the pocket structure and the objects or contents contained therein. Such other closure means could of course include snap-type fasteners, zippers and any other closure structure capable of sufficiently maintaining a closed orientation of the entrance means of the pocket structure 14.

Another important structure feature of the present invention is the provision of forming or manufacturing the side wall means 16 out of a water impermeable or waterproof material. This is provided of course to prevent excess moisture entering the interior of the pouch structure causing damage to the valuables or contents contained therein. Alternately, the pouch structure may include side wall means 16 having a liner element attached thereto wherein the liner element is formed from a water impermeable material. Again, the purpose is to prevent exposure of the objects contained on the interior of the pouch structure from excess moisture.

Finally, an additional structural feature of the present invention is the location of the pouch structure 14 at any point on the sheet element 12. A shown in FIG. 1, the pouch structure is located in the approximate center of the sheet element and depends from the substantial center of the undersurface thereof. However, it should be readily apparent that the precise location of the pouch structure could be closer to either end 18 or 22 or to the peripheral borders of side portions 20 or 24.

What is claimed is:

1. A ground covering assembly of the type primarily designed for one to lie upon when spread over a ground surface area, said covering assembly comprising:

(a) a sheet element formed from a material sufficiently flexible to conform to the ground surface being covered and including side portions extending the length thereof, (b) a pouch structure attached to said sheet element and disposed to depend from an undersurface thereof, said pouch structure including an entrance means disposed and configured to provide access to the interior thereof, said side portions secured about the peripheral edge portion of said entrance means, (c) said entrance means disposed contiguous said exposed surface of said sheet element, whereby said pouch structure is substantially hidden from view, (d) a closure means secured to said peripheral edge portions of said entrance means and disposed to extend substantially along the length thereof, said closure means structured to be brought into mating engagement with itself thereby defining a closed configuration of said pouch structure and encasing contents of said pouch structure therein, (e) said pouch structure configured to define a closable container being disposed and structured for at least partial burial in the ground covered by said sheet element, (f) whereby objects may be enclosed within said pouch structure and stored out of sight from the exposed surface of said sheet element.

2. A ground covering assembly as in claim 1 wherein said closure means comprises closure strips secured to and extending along opposite peripheral edge portions of said entrance means and positioned into mating engagement with one another so as to close said entrance means and substantially encase objects within said pouch structure.

3. A ground covering assembly as in claim 2 wherein said oppositely disposed closure strips respectively comprise hook and loop type fasteners positionable into mating engagement with one another, said entrance means accordingly being disposed into a closed position, whereby objects within the interior of said pouch structure are substantially encased.

4. A ground covering assembly as in claim 1 wherein said sheet element comprises an aperture formed therein and disposed inwardly from the peripheral borders of said sheet element; said entrance means having its periphery secured to the periphery of said aperture contiguous said exposed surface of said sheet element.

5. A covering assembly as in claim 1 wherein said pouch structure comprises a side wall disposed in depending relation from said undersurface of said sheet element and integrally formed from a water impermeable material, whereby contents of said pouch structure are protected against exposure to moisture when said pouch structure is buried.

6. A covering assembly as in claim 1 wherein pouch structure comprises a side wall disposed in depending relation from said undersurface of said sheet element, said side wall including a liner formed from a water impermeable material, whereby contents of said pouch structure are protected against exposure to moisture when said pouch structure is buried.

7. A covering assembly as in claim 1 wherein said sheet element comprises a first side portion secured immediately adjacent an outer peripheral edge of a side wall means of said pouch structure, a second side portion secured to an oppositely disposed peripheral edge of said side wall means at a predetermined greater spaced apart distance from the outermost peripheral edges thereof then said first side portion, whereby said entance means is effectively disposed in the plane of said exposed surface of said sheet element.

* * * * *